US005092149A

United States Patent [19]

Bartsch et al.

[11] Patent Number: 5,092,149

[45] Date of Patent: Mar. 3, 1992

[54] COMBINATION LATCH FOR LUGGAGE

[75] Inventors: Georg Bartsch; Ulf Rasch, both of Iserlohn; Klaus Hesse, Sundern-Amecke; Franz Hauschulte, Menden, all of Fed. Rep. of Germany

[73] Assignee: Sudhaus Schloss-und Beschlagtechnik GmbH & Co., Iserlohn, Fed. Rep. of Germany

[21] Appl. No.: 674,770

[22] Filed: Mar. 25, 1991

[30] Foreign Application Priority Data

Mar. 24, 1990 [DE] Fed. Rep. of Germany ..... 4009526

[51] Int. Cl.[5] ..... E05B 37/02

[52] U.S. Cl. ..... 70/312; 70/317

[58] Field of Search ..... 70/312, 315–319, 70/311, 321, 322, DIG. 44, 71, 72, 3

[56] References Cited

U.S. PATENT DOCUMENTS

| | | | |
|---|---|---|---|
| 3,555,860 | 1/1971 | Atkinson | 70/312 |
| 4,355,524 | 10/1982 | Bako | 70/312 |
| 4,520,641 | 6/1985 | Bako | 70/312 |
| 4,554,809 | 11/1985 | Yang | 70/312 |
| 4,711,108 | 12/1987 | Garro | 70/312 |
| 4,719,776 | 1/1988 | Molnar | 70/312 |

FOREIGN PATENT DOCUMENTS

| | | |
|---|---|---|
| 2828057 | 12/1980 | Fed. Rep. of Germany . |
| 3030440 | 3/1981 | Fed. Rep. of Germany . |
| 2830091 | 6/1982 | Fed. Rep. of Germany . |
| 2946091 | 6/1983 | Fed. Rep. of Germany . |
| 2816073 | 9/1984 | Fed. Rep. of Germany . |

*Primary Examiner*—Lloyd A. Gall
*Attorney, Agent, or Firm*—Herbert Dubno; Andrew Wilford

[57] ABSTRACT

A luggage latch has a housing mounted on a piece of luggage and a latch body or slide displaceable in the housing between a latched and unlatched position and engageable only in the latched position with a latch component on the luggage lid to retain the latch component. A slide button fixed to the latch body is longitudinally displaceable on the housing between a forward position corresponding to the latched position and a back position corresponding to the unlatched position. A plurality of number wheels rotatable on the housing are associated with respective rotatable members and formations can engage between the members and the latch body to prevent movement of the latch body into the unlatched position except when the wheels are in a predetermined angular position. Respective couplings between each of the wheels and the respective member are movable between a coupled position for joint rotation of each member with the respective wheel and a decoupling position for rotation of each member independently of the respective wheel. A coding element connected to the couplings is displaceable between a coded position setting the couplings in the coupled position and a coding position setting the couplings in the uncoupled position. The coding element is wholly enclosed in the housing, is exposed only in the back position of the slide button, and is covered by the slide button in the forward position thereof.

11 Claims, 4 Drawing Sheets

COMBINATION LATCH FOR LUGGAGE

FIELD OF THE INVENTION

The present invention relates to a combination lock or latch. More particularly this invention concerns such a latch used on a piece of luggage such as a suitcase, attache case, trunk case, or the like.

BACKGROUND OF THE INVENTION

A standard luggage latch has a housing mounted on the piece of luggage and a latch body or slide displaceable in the housing between a latched and unlatched position and engageable only in the latched position with a latch component on the luggage lid to retain the latch component. A slide button fixed to the latch body is longitudinally displaceable on the housing between a forward position corresponding to the latched position and a back position corresponding to the unlatched position. A plurality of number wheels rotatable on the housing are associated with respective rotatable members and formations can engage between the members and the latch body to prevent movement of the latch body into the unlatched position except when the wheels are in a predetermined angular position. Respective couplings between each of the wheels and the respective member are movable between a coupled position for joint rotation of each member with the respective wheel and a decoupling position for rotation of each member independently of the respective wheel. A coding element connected to the couplings is displaceable between a coded position setting the couplings in the coupled position and a coding position setting the couplings in the uncoupled position.

Thus the coding element is actuated to allow a new combination to be set. The item carrying the latch is supplied to the user with a standard combination, normally 0-0-0, and the user can thereafter reset the combination to his or her own number. At a later date the user can even reset the combination. It is therefore necessary that this coding element be accessible enough that it is relatively simple for a person to actuate it to reset the combination, but not so accessible that it can be accidentally actuated and allow the combination to be accidentally reset.

In German patents 2,828,057 and 2,830,091 of Peter Milles the coding element is exposed on the inside of the latch housing, which in turn is exposed on the inside of the piece of luggage. Thus it is possible for the contents of the luggage to actuate this element and allow the combination to be reset inadvertently, leaving the user with a locked bag and no knowledge of the new combination. Alternately some form of protection for this element must be provided inside the bag, increasing costs to make the luggage.

German patent 2,816,073 of Lazlo Bako (based on U.S. application 855,602 filed 29 Nov. 1977) has a coding element which is covered by the latching component, typically a tongue, when the latch is closed, and which can be actuated only when the catch button is further depressed. When the latch is opened this element is exposed in the hole in the latch housing into which the eye of the latch tongue fits. This element is therefore exposed whenever the luggage is open, leaving considerable time for accidental actuation. In addition it is fairly obviously exposed and can be operated relatively easily by anyone even vaguely familiar with the latch with no need of tools.

Other systems are described in German patent 2,946,09I of Peter Milles and German patent document 3,030,440 of Claudio Castiglioni (based on an Italian priority date of 07 Sept. 1979). In these arrangements the catch button is actuated in a particular nonstandard manner for resetting the code. Unfortunately these procedures are just the type of thing that someone checking out the luggage in a showroom, for example, might do, so that the combination gets reset to a new unknown combination, making the luggage useless. The same thing can happen even if a child, for instance, plays with the catch. Although special inserts can be provided (see for example German patent 2,938,999 and German utility model 8,109,279) to prevent this from happening, this extra part once again complicates manufacture and adds to costs.

OBJECTS OF THE INVENTION

It is therefore an object of the present invention to provide an improved luggage latch.

Another object is the provision of such an improved luggage latch which overcomes the above-given disadvantages, that is which on the one hand can have its combination reset rather easily, but which on the other hand cannot be reset either accidentally or without specific knowledge how to do it.

SUMMARY OF THE INVENTION

The instant invention is an improved luggage latch of the general type described above but wherein the coding element is wholly enclosed in the housing, is exposed only in the back position of the slide button, and is covered by the slide button in the forward position thereof. Thus the coding element is not even visible or accessible unless the catch button is pushed back, so that the likelihood of anything acting on it is extremely small. Since the catch button is only pushed back for the instant when it is actuated to release the latch component on the other part of the piece of luggage, its exposure is extremely limited. Thus only a person who knows exactly how to gain access to the coding element is likely to actuate it.

According to another feature of this invention the element has an outside actuation part exposed immediately adjacent the button only in the back position thereof. This part is in fact exposed in front of the catch button where the user's finger is normally located during actuation of the latch, so that it is even normally obscured from view during such normal actuation. In fact according to a particular feature of this invention the outside actuation part is substantially smaller than a fingertip and is formed with an outwardly directed small-diameter recess. Thus not only will the user's finger cover the coding element during actuation of the catch, but even if the button is pushed back with, for instance, the user's fingernail so that the actuation part of the coding element is exposed, it still is necessary for the user to employ a tool, for instance a writing instrument, to shift it into the coding position.

In accordance with a further feature of this invention the element has an inside part pivoted in the housing about a longitudinal axis. In addition means is provided for retaining the element in a pair of end positions respectively corresponding to the coupled and decoupled positions of the couplings. Furthermore in the coding position the element blocks movement of the latch body from the unlatched into the latched position. Thus once the catch button has been pushed back and the user has employed a pointed tool to shift the lever into the coding position, the lever holds in this position and the catch button is retained in the back unlatched position. The user can then easily reset the wheels to the desired combination, using both hands if necessary. This feature is particularly useful when two such combination latches are provided on, for instance, an attache case, as it allows the user to verify that both combinations are the same before setting the coding elements back to the coded position. Once the combination has been reset the tool is again employed to push the lever back into the coded position, automatically latching the lever in this position and allowing the catch button to snap back into the latched position.

In the system of this invention the members are rings within the respective wheels and the couplings are external teeth on the rings and complementary internal teeth on the wheels. Furthermore the couplings include an axle extending through all of the rings and on which the rings are rotatably mounted and the element is formed with an angled camming ramp engageable axially with the axle on displacement from the coded to the coding position. A spring urges the axle in a direction against the element and urges the body into the latching position. Thus a single spring serves both as biasing means for the couplings and for the latch body.

BRIEF DESCRIPTION OF THE DRAWING

The above and other objects, features, and advantages will become more readily apparent from the following, reference being made to the accompanying drawing in which:

FIG. 9 a section taken along line IXa—IXa of FIG. 9.

SPECIFIC DESCRIPTION

Figure 1:
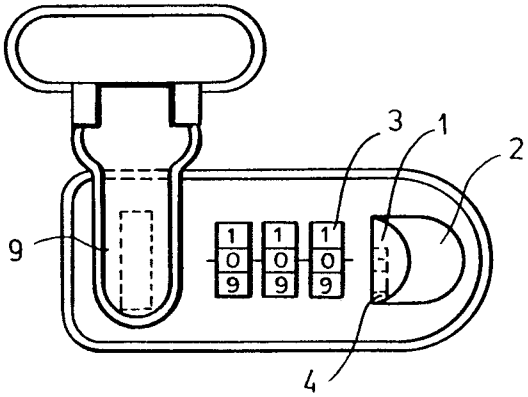
FIG. 1 is a front view of the latch according to this invention.
Figure 2:
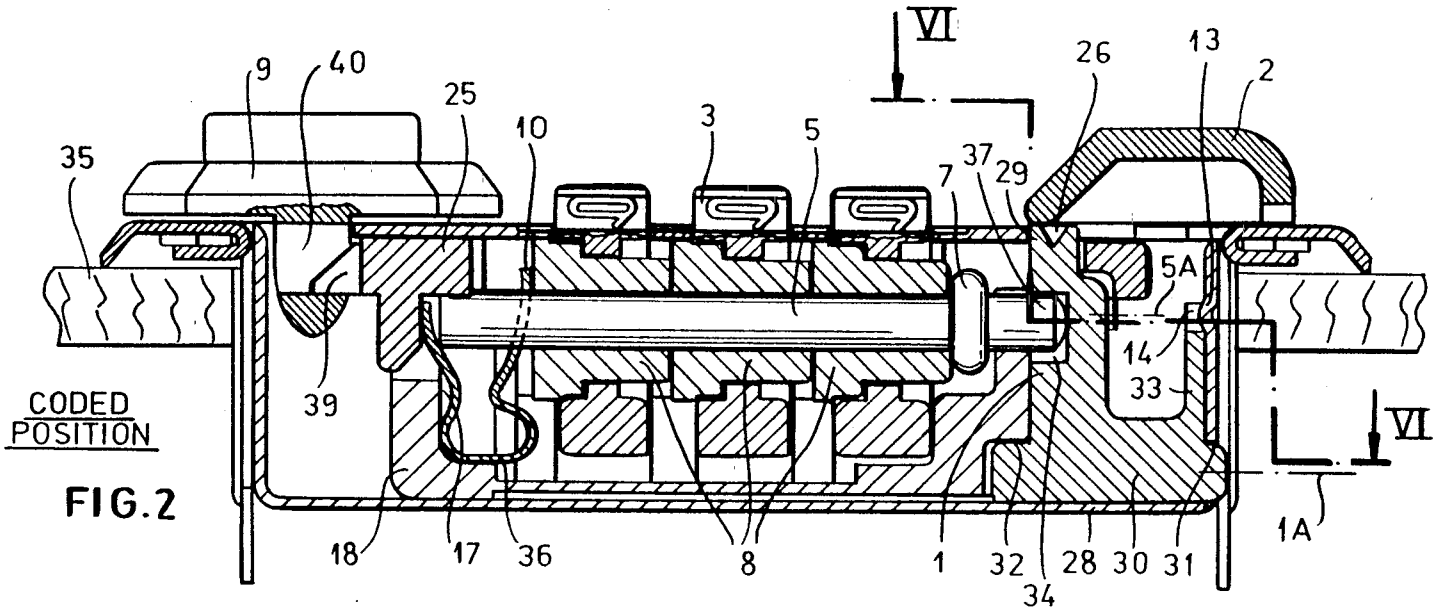
FIG. 2 is a large-scale longitudinal section through the latch in a latched and coded position thereof.
Figure 3:
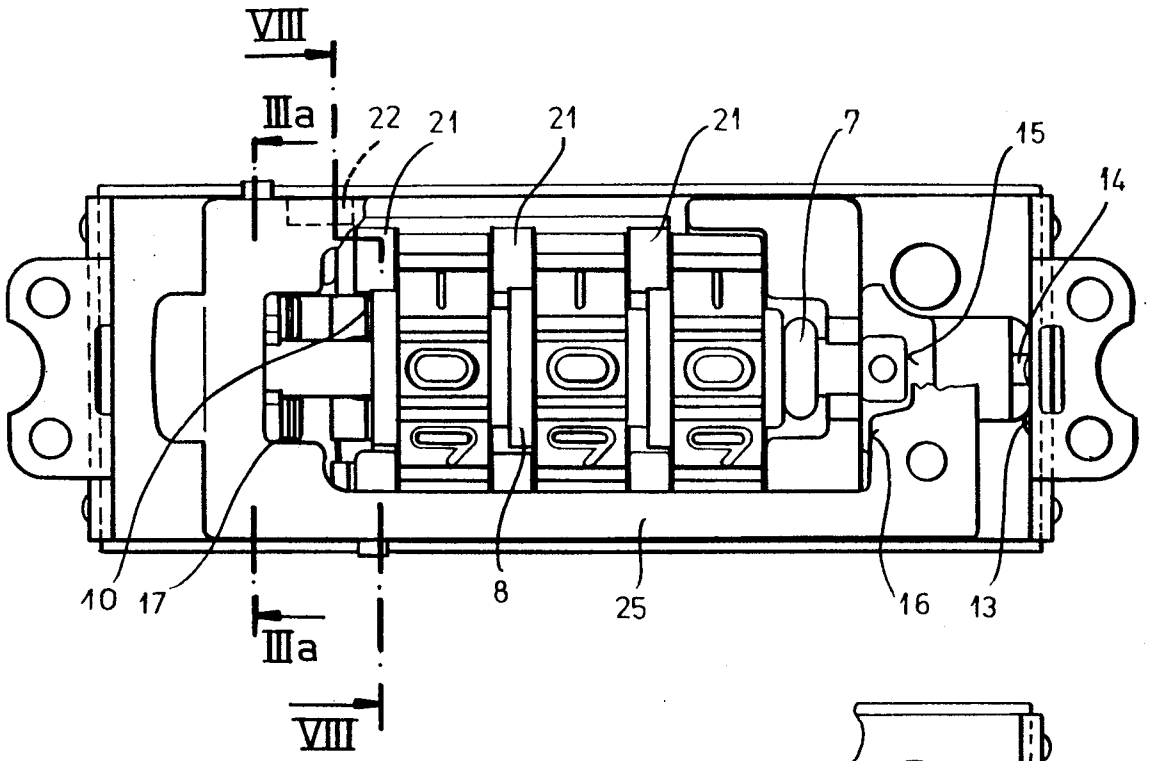
FIG. 3 is a view of the latch as seen in FIG. 2 but with the top cover plate removed for clarity of view.

As seen in FIGS. 1, 2, and 3 the latch according to this invention has a housing 28 whose front side is mounted generally flush with a wall 35 of a piece of luggage having another part or a lid provided with a conventional latch tongue 9 that can be captured in the latch. The latch has three combination wheels 3 visible to the user and a button 2 that is pushed back, that is to the right in FIGS. 1 through 3, away from the tongue 9 to free this tongue 9 and to expose a coding lever 1 in a window 4. This lever 1 is covered by the button 2 in the normal position of same and in fact is also covered by the finger of the user during normal use of the button 2.

Figure 7:
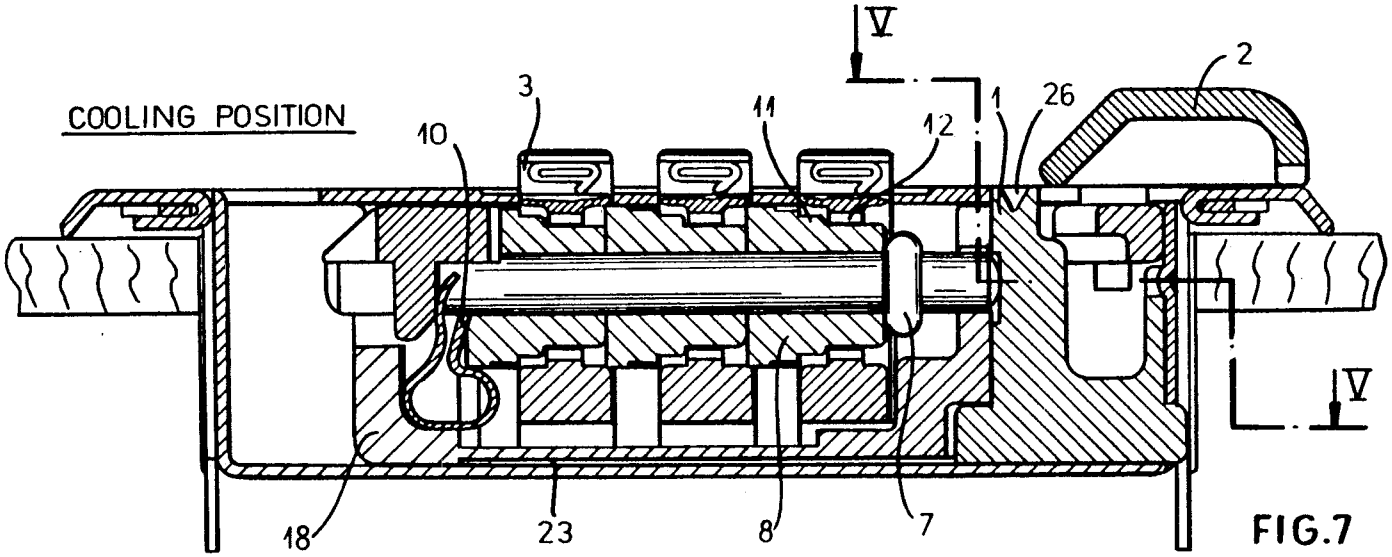
FIG. 7 is a view like FIG. 2 but with the latch in the coding and unlatched position.
Figure 5:
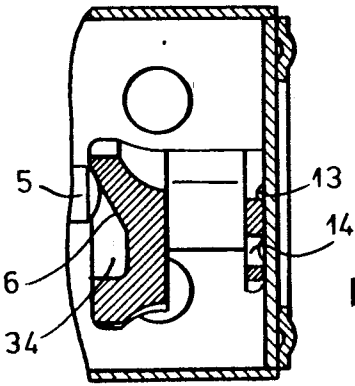
FIG. 5 is a section taken along line V—V of FIG. 7.
Figure 6:
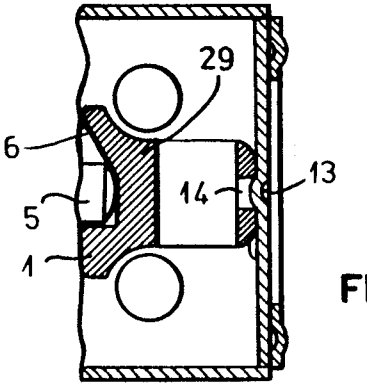
FIG. 6 is a section taken along line VI—VI of FIG. 2.
Figure 9:
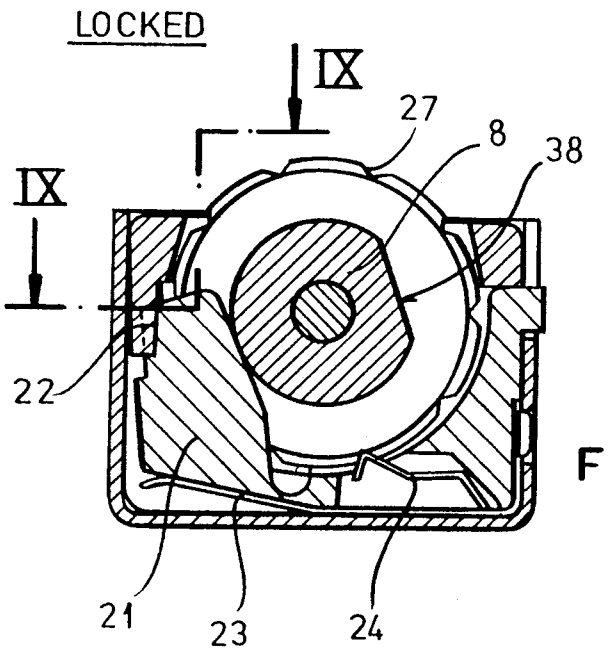
FIG. 9 is a section like FIG. 8 but with the latch in the locked position.
Figure 9A:
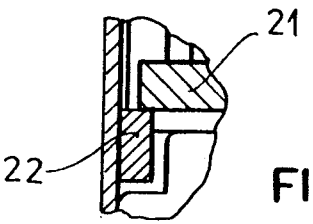
Figure 8:
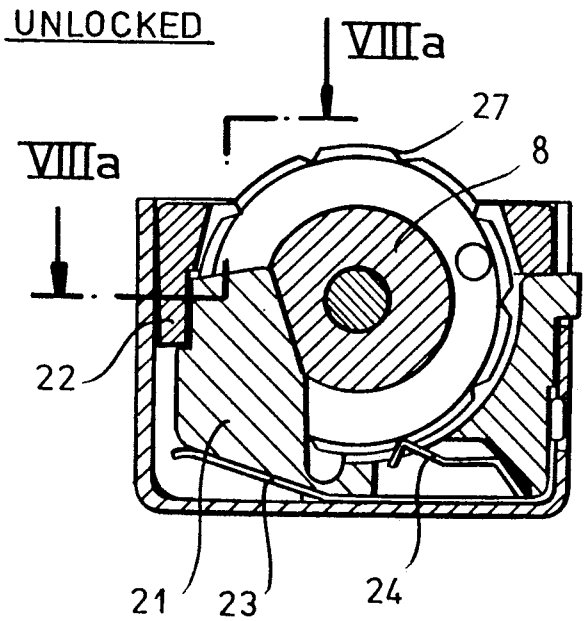
FIG. 8 is a section taken along line VIII—VIII of FIG. 3 with the latch in the unlocked position.
Figure 8A:
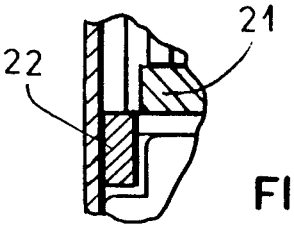
FIG. 8*a* is a section taken along line VIIIa—VIIIa of FIG. 8.

The lever 1 has an inner end formed as a pivot pin 30 seated at its rear end in a recess 31 formed in the housing 28 and at its front end in a seat 32 formed in a holder 18 fixed in the housing 28 and containing the wheels 3 so as to define a longitudinal pivot axis IA for the lever 1. This lever 1 has a front arm 29 whose end is formed with a small recess 26 and that is exposed in the window 4 which is elongated transversely of the housing 28. It also has a back arm 33 extending radially from the pivot axis 1A and formed as seen in FIGS. 5 and 6 with a hole 14 in which can engage a bump 13 formed on the housing 28 and defining two angularly offset stable positions for this lever 1, the coded position of FIGS. 2 and 6 and the coding position of FIGS. 5 and 7.

Figure 3A:
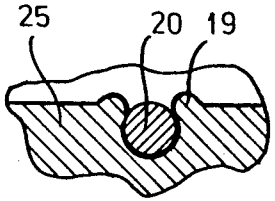
FIG. 3*a* is a section taken along line IIIa—IIIa of FIG. 3.

The arm 29 is further formed with an axially forwardly open cutout 34 in which can engage a rear end 37 of an axle 5 on which the three wheels 3 are centered about an axis 5A. The cutout 34 has an inclined ramp or camming surface 6 engageable with the end 37 of the axle 5 to push same forward, moving it from the position of FIG. 6 to that of FIG. 5 when the lever 1 is pivoted from the coded to the coding position. This axle 5 has a front end 20 received as seen in FIG. 3*a* in a seat 19 formed in a slide 25 that is moved back away from the tongue 9 by the button 2 to pull its end 39 out of a hole 40 in the tongue 9 and thereby free this tongue 9. In addition as seen by comparing FIGS. 3 and 4 the lever 1 has a back surface 15 that can engage in front of a forwardly facing surface 16 of the slide 25 in the coding position of this lever 1 and the retracted open or unlocked position of the slide 25. Thus when the lever 1 is in the coding position, it retains the slide 25 in the rear unlatched position.

Each wheel 3 surrounds a respective coaxial coding ring 8 that is rotatable and axially displaceable on the axle 5 and on which in turn the respective wheel 3 is carried. The rearmost ring 5 bears axially on a collar 7 fixed or formed on the axle 5 and the frontmost ring 8 is urged axially backward by one arm 10 of a leaf spring 36 whose other arm 17 bears axially forward on the slide 25 so as simultaneously to urge the slide 25 forward into the latching position and the rings 8 backward. Each ring 8 has external teeth 11 that can mesh with internal teeth 12 of the respective wheel 3 so as to rotationally couple each ring 8 with the respective wheel 3. When shifted axially forward, however, it is possible to disengage the teeth 11 of each ring 8 from the teeth 12 of the respective wheel 3 and thereby rotationally decouple same from each other.

In addition as best seen in FIGS. 8, 8*a*, 9, and 9*a*, the holder 18 is unitarily formed with three movable segments or teeth 21 that are each urged by a respective spring 23 into radial contact with a respective one of the wheels 8. The rings 8 are each formed with a secantal flat 38 so that in one angular position of each ring 8 it is possible for the respective tooth 21 to move from t he outer locked position of FIGS. 9 and 9*a* to the inner unlocked position of FIGS. 8 and 8*a*. The slide 25 itself is formed at each segment 21 with a projection 22 that can only move past the respective segment 21 when same is in the inner unlocked position.

The spring 23 also has an arm 24 that can engage in radially outwardly open notches 27 of the respective wheel 3 to define therefor ten stable positions. Each wheel 3 further carries numbers from 0 to 9 corresponding to the positions defined by the interfit of the ar 24 in the notches 27.

The latch described above functions as follows:

When the numbers on the wheels 3 corresponding to the set combination are aligned on the face of the latch, it is possible to unlatch it and release the tongue 9 simply by pushing back the button 2. This action pulls back the slide 25 to free its end 39 from the hole 40 in the tongue 9 so that the normally spring-loaded tongue 9 can snap up, allowing the luggage to be opened. During this backward movement of the slide 25 the projections 22 thereon move past the segments 21 which are all engaged against the flats 38 of the respective rings 8. Since the button 2 is pushed back away from the tongue 9 and from the window 4 where the element 1 is exposed, during such actuation this lever 1 normally is not exposed.

If so much as one of the wheels 3 is rotated so that its flat 38 does not lie against the respective segment 21, this segment 21 will block backward movement of the slide 25 and will prevent the latch from being opened.

To change the combination it is necessary to be able to slide the button 2 back into the unlatched position of the unit, which of course can only be done when the set combination has been set as described above. Once the button 2 is pushed back to expose the lever end 29 in the window 4 some sharp object like a pen tip is engaged in the recess 26 and the lever 1 is pivoted from the coded position of FIG. 6 to the coding position of FIG. 5. The exposed end 29 of the lever 1 is flush with the outer face of the latch housing 28 and is much too small to be engaged by the finger of the user, so it is impossible to accidentally move the lever 1 into the coding position, especially as the retention of the interfit between the bump 13 and recess 14 must be overcome.

Figure 4:
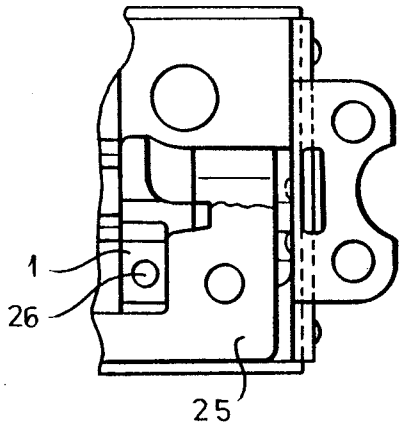
FIG. 4 is a view of a detail of the latch as seen in FIG. 3 but in the coding and unlatched position.

Movement of the lever I into the coding position brings its back face 15 in front of the face 16 of the slide 25 as indicated in FIG. 4 to retain this slide 25 in the latched position so that the user can release the button 2. This movement also forces the ramp 6 against the end 37 of the axle 5 to push same forward against the force of the spring 36 and thereby also pull the teeth 11 of the rings 8 out of mesh with the teeth 12 of the respective wheels 3. The mechanism is left in the position of FIG. 7 with the wheels 3 freely rotatable about the axis 5A independently of the rings 8. The user can then set the new combination on the wheels 3.

Once the new combination is set, the tool is again used to pivot the lever 1 back from the coding (FIG. 5) to coded (FIG. 6) position. This action simultaneously allows the axle 5 and the rings 8 to move back and allows the slide 25 to move forward. The teeth 11 of the rings 8 will mesh with the teeth 12 of the respective wheels 3 and will establish the new combination.

We claim:

1. In a combination luggage latch comprising:

a housing adapted to be mounted on a piece of luggage;

a latch body displaceable in the housing between a latched and unlatched position and engageable only in the latched position with a latch component on the luggage to retain the latch component;

a slide button fixed to the latch body and longitudinally displaceable on the housing between a forward position corresponding to the latched position and a back position corresponding to the unlatched position;

a plurality of number wheels rotatable on the housing;

respective members associated with the wheels and rotatable in the housing;

means including formations on the members and on the latch body for preventing movement of the latch body into the unlatched position except when the wheels are in a predetermined angular position;

means including respective couplings between each of the wheels and the respective member movable between a coupled position for joint rotation of each member with the respective wheel and an uncoupled position for rotation of each wheel independently of the respective member;

a coding element operatively associated with the couplings and displaceable between a coded position setting the couplings in the coupled position and a coding position setting the couplings in the uncoupled position; the improvement wherein the element is substantially wholly enclosed in the housing, is displaceable independently of the slide button, is exposed only in the back position of the slide button, and is covered by the slide button in the forward position thereof.

2. The improved combination luggage latch defined in claim 1 wherein the element has an outside actuation part exposed immediately adjacent the button in the back position thereof.

3. The improved combination luggage latch defined in claim 2 wherein the outside actuation part is substantially smaller than a fingertip and is formed with an outwardly directed small-diameter recess.

4. The improved combination luggage latch defined in claim 2 wherein the element has an inside part pivoted in the housing about a longitudinal axis.

5. The improved combination luggage latch defined in claim 4, further comprising means for retaining the element in a pair of end positions respectively corresponding to the coupled and uncoupled positions of the couplings.

6. The improved combination luggage latch defined in claim 1 wherein in the coding position the element blocks movement of the latch body from the unlatched into the latched position.

7. The improved combination luggage latch defined in claim 1 wherein the members are rings within the respective wheels and the couplings are external teeth on the rings and complementary internal teeth on the wheels.

8. The improved combination luggage latch defined in claim 7 wherein the means including the couplings further includes an axle extending through all of the rings and on which the rings are rotatably mounted, the element being formed with an angled camming ramp engageable axially with the axle on displacement from the coded to the coding position.

9. The improved combination luggage latch defined in claim 8 wherein the element is a lever.

10. The improved combination luggage latch defined in claim 8, further comprising a spring urging the axle in a direction against the element and urging the body into the latched position.

11. The improved combination luggage latch defined in claim 7 wherein the rings have substantially cylindrical outer peripheries each formed with a respective inset flat, the interengaging formations including respective segments unitary with the housing and radially engageable with the respective peripheries, the means for preventing further including respective spring means for urging the segments radially against the respective peripheries, the segments blocking axial movement of the latch body except when engaged against the respective flats.

* * * * *